US006062340A

United States Patent [19]

Walker

[11] Patent Number: 6,062,340

[45] Date of Patent: May 16, 2000

[54] EMERGENCY TREE AND HEIGHT DESCENDER

[76] Inventor: George Kriston Walker, 7277 Cascade, Boise, Id. 83704

[21] Appl. No.: 09/260,407

[22] Filed: Mar. 2, 1999

[51] Int. Cl.[7] ..... A62B 1/16

[52] U.S. Cl. ..... 182/5; 182/192

[58] Field of Search ..... 182/5, 191, 192, 182/193; 188/65.2–65.5

[56] References Cited

U.S. PATENT DOCUMENTS

| | | | |
|---|---|---|---|
| 504,868 | 9/1893 | Engelke | 182/5 |
| 4,311,218 | 1/1982 | Steffen | 182/5 |
| 4,678,059 | 7/1987 | Bowker | 182/5 |
| 4,702,349 | 10/1987 | Lew | 182/5 |
| 5,145,036 | 9/1992 | Omalia | 182/193 |

*Primary Examiner*—Alvin Chin-Shue
*Attorney, Agent, or Firm*—Charles R. Clark

[57] ABSTRACT

A compact, lightweight, self-contained rappel apparatus by which a person such as a parachuting smoke jumper, aviator, or other person may safely descend a line or rope from a tree canopy or other high perch to the ground or a lower elevation. The invention is designed for one-handed use with a preferred figure 8 system of descent line reeving around and about the top pipe and bottom pipe of the descender that results in multiple frictional line-to-line contact points as the line crosses itself in each figure 8 wrap in the area between the top pipe and bottom pipe.

8 Claims, 2 Drawing Sheets

EMERGENCY TREE AND HEIGHT DESCENDER

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

The present invention relates to a compact, lightweight, self-contained rappel apparatus by which a person such as a parachuting smoke jumper, aviator, or other person may safely descend a line or rope from a tree canopy or other high perch to the ground or a lower elevation. The invention can also serve as a useful means of escape for a person from an upper floor of a building or other structure when the normal means of egress are blocked by fire or other hazardous condition.

2. Description of Related Art

A number of devices exist that can aid a person in descending or rappeling down a line to a lower elevation and in particular in descending from a tree canopy environment. In U.S. Pat. No. 4,102,431 issued to Carroll is disclosed a complex emergency personnel lowering apparatus for use with an accompanying lowering line for carriage and use by an aircrewman. In U.S. Pat. No. 3,419,236 issued to Weber, the problem of rescuing aircrewmen from high trees is also addressed. The prior devices are generally more cumbersome, bulky, and complex than the present invention. The present invention provides for a less complex descender that preferably uses a small diameter, high strength aramid kernmantle fiber line such as 3 mm Technora® cordage.

Generally prior art rappeling devices have utilized friction between the line and the device to slow descent by generating heat primarily in the structure of the device. The present invention permits a novel reeving of the line onto the invention resulting in multiple frictional line-to-line contact points as the line crosses itself. The line-to-line contacts result in a portion of the heat generated by braking to be imparted into the line directly and not directly into the structure of the descender. The invention thus is able to operate without building up as much heat in the structure of the descender as it would without the line-to-line contacts.

BRIEF SUMMARY OF THE INVENTION

A principal objective of this invention is to provide a novel and improved palm-sized descender that is lightweight, compact, simple, low-maintenance, and reliable for use in a system that permits a person's safe descent while rappeling from a high place such as a tree canopy. In the preferred embodiment, the descender's overall size approximates the overall size of a standard locking gate carabineer.

The descender is designed to be used as part of a system comprising a preloaded lowering line and anchor means. Use of the invention will permit a parachuting smoke jumper or other parachutists or other persons stranded in tall trees and other high places to safely descend to the ground or lower elevations even when limited by injury or other reason to the use of one hand. The line is reeved for braking purposes through the descender and connected by suitable anchor means to the tree or other high place from which descent is to be made.

Once descent is commenced, the user of this invention can easily and safely with a single, bare hand regulate his speed of descent. The descender acts as a radiator of the heat developed by the friction of the running rope around and about the descender's top pipe and bottom pipe. The bare hand can serve as an effective heat sink for the generated heat and can also serve as a meaningful sensor for the user that the speed of descent is appropriate. The preferred method of reeving of the line onto the descender allows the user to compress crossing line portions together resulting in increasing friction between line portions resulting in more effective braking.

The present invention overcomes a significant problem that is encountered by many other rappeling devices. The significant problem is descent line twisting. The present invention uses figure 8 reeving of the descent line that imparts minimal twist to the descent line during descent.

The invention is intended to be used in its preferred embodiment with figure 8 reeving of the descent line onto the descender that results in multiple frictional line-to-line contact points as the line crosses itself in each figure 8 wrap in the area between the top pipe and bottom pipe.

The descender's structure provides an enclosed lower area bounded by a U-shaped member and a bottom pipe through which conventional attachment means can be employed to attach the U-shaped member of the descender to the body of the user. Conventional attachment means include standard gated carabineers that can clip the descender to the user's body harness or other means of securing a body to a rappeling device that are well-known to climbers. The U-shaped member in the preferred embodiment of the invention is sized to allow the enclosed lower area to accommodate the attachment of two standard carabineers.

DETAILED DESCRIPTION OF THE INVENTION

Figure 1:
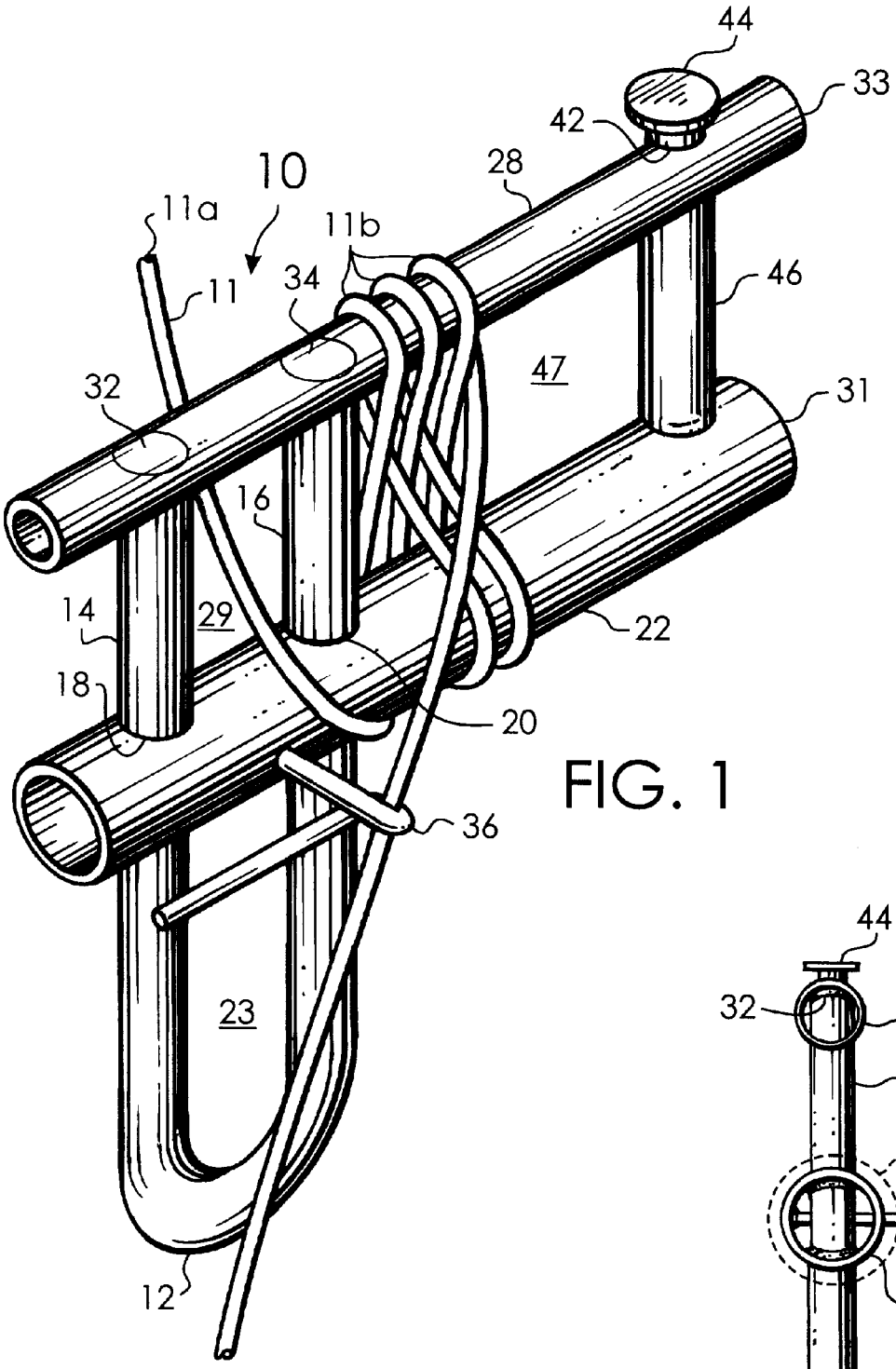
FIG. 1 is a schematic perspective view of the descender in the preferred embodiment showing the preferred line configuration for use in descending.
Figure 2:
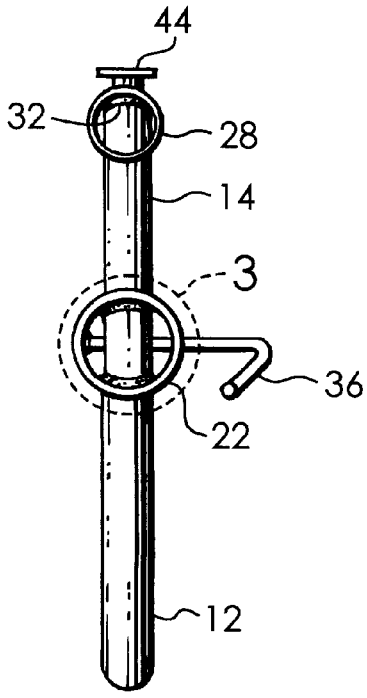
FIG. 2 is a schematic end view of the descender shown in FIG. 1.
Figure 3:
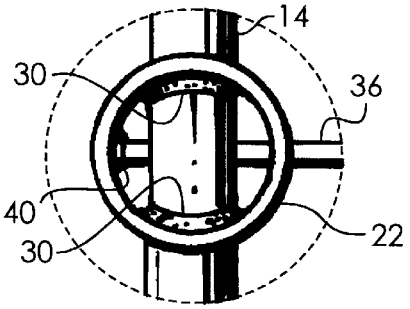
FIG. 3 is a schematic enlarged, partial view of the descender as indicated in FIG. 2.
Figure 5:
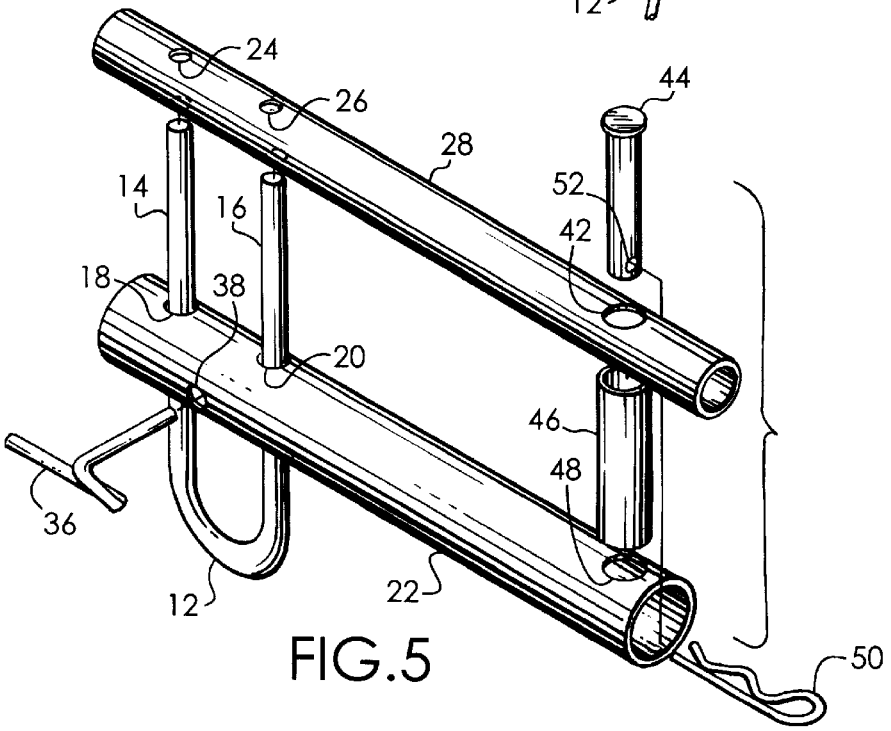
FIG. 5 is a schematic exploded perspective view of the descender in the preferred embodiment showing all of its component parts.

In the best embodiment of the descender 10 as shown in FIGS. 1 and 5, all its component parts are fabricated from stainless steel. A U-shaped member 12 formed preferably from rod has an outer leg 14 and an inner leg 16. Preferably the legs 14 and 16 are parallel to and of equal length to each other and pass up through bottom pipe 22 through respective close-fitting, lower receiving through holes 18 and 20 in the bottom pipe 22 and then extend and pass into a top pipe 28 into respective close-fitting, upper receiving through holes 24 and 26 in the top pipe 28. Preferably the top pipe 28 is somewhat longer than bottom pipe 22. The pipes 22 and 28 are preferably spaced about 20 mm apart and parallel to each other. The lower receiving through holes 18 and 20 are preferably transverse to the longitudinal axis of the bottom pipe 22 and the axes of the holes respectively intersect the axis of the bottom pipe. The upper receiving through holes 24 and 26 are preferably transverse to the longitudinal axis of the top pipe 28 and the axes of the holes respectively intersect the axis of the top pipe. The through holes 18 and 24 are coaxial as are through holes 20 and 26. The through holes 20 and 26 into which inner leg 16 passes are respectively located toward or near the mid-lengths of bottom pipe 22 and top pipe 28. The bottom pipe 22 is securely joined to the outer leg 14 at approximately the mid-length of the leg preferably by welds 30 within the bottom pipe as shown in FIGS. 2 and 3. The top pipe 28 is securely joined to legs 14 and 16 preferably by fill welds 32 and 34 as shown in FIG. 1. The bottom pipe 22 has a bottom extending end 31 and top pipe 28 has a top extending end 33. Extending ends 31 and 33, each extend longitudinally outward beyond the inner leg 16 and in the direction away from outer leg 14 to a length preferably at least equal to the distance that separates the legs 14 and 16 from each other.

In the best embodiment, a tailing loop 36 is formed preferably from rod. The tailing loop 36 is inserted into a close-fitting, loop receiving through hole 38 in the bottom pipe 22. Loop receiving through hole 38 is transverse to the longitudinal axis of the bottom pipe 22 and the axis of the hole intersects the axis of the bottom pipe. Preferably the axis of loop receiving through hole 38 is perpendicular to a plane through the longitudinal axes of legs 14 and 16 and spaced between them. The inserted end of loop 36 is securely joined to the bottom pipe 22 preferably by a fill weld 40 as shown in FIGS. 2 and 3. The tailing loop 36 preferably is spaced between the outer leg 14 and the inner leg 16.

In the best embodiment, removable bridging means are provided for bridging between the extending ends 31 and 33.

In the best embodiment, the removable bridging means comprises a clevis pin 44, spacer sleeve 46, clevis pin clip 50, and clevis pin hole 52 that bridges between and gates off the extending ends 31 and 33. The clevis pin 44 and spacer sleeve 46 are retained as part of the descender 10 by insertion of the clevis pin 44 first through a clevis pin through hole 42 in the top pipe 28, then insertion of the pin through the spacer sleeve, then insertion of the pin through a wall hole 48 located in the wall of the bottom pipe 22 and then by insertion of a clevis pin clip 50 into a clevis pin hole 52 located near the inserted end of the clevis pin 44 and within the interior of the bottom pipe 22. When properly assembled, the clevis pin clip 50 is protected against inadvertent removal by its guarded location within the end of the bottom pipe 22. The wall hole 48 is coaxial to the clevis pin through hole 42 and preferably the axis of the holes is parallel to the axes of the through holes 18, 20, 24, and 26.

Figure 4:
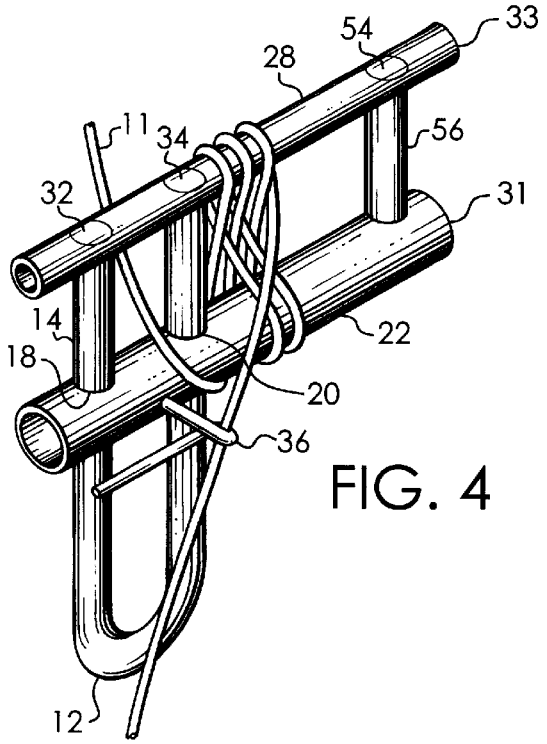
FIG. 4 is a schematic perspective view of the descender according to an alternative embodiment showing the preferred line configuration for use in descending.

An alternative embodiment has nonremovable bridging means for bridging between the extending ends 31 and 33 and includes a bridge member 56 that is securely joined between and to the extending ends by welding or other appropriate joining means including threaded nuts or retaining pins. FIG. 4 shows the use of a fill weld 54.

A simpler, alternative embodiment of descender 10 does not include bridging means, but leaves the extending ends 31 and 33 open and unbridged.

The best embodiment of the descender 10 comprises three enclosed open areas: lower area 23, top area 29, and lateral area 47 defined respectively by U-shaped member 12 and bottom pipe 22, by bottom pipe 22, outer leg 14, top pipe 28, and inner leg 16, and by inner leg 16, top pipe 28, spacer sleeve 46, and bottom pipe 22. The portion of U-shaped member 12 that forms part of the boundary of enclosed lower area 23 can be conveniently used by attachment means to attach the user to the descender 10. Various attachment means of attaching a climber to a descender or rappeling device are well-understood in the climbing art and include the use of standard carabineers, webbing, and cordage.

After welding, the fill welds 32 and 34 and the fill weld 40 with respect to the end of tailing loop 36 that joins the loop to bottom pipe 22 are ground to the same curves as the respective surfaces of top pipe 28 and bottom pipe 22.

In the alternative embodiment illustrated in FIG. 4, the fill weld 54 is ground to the same curve as the surface of top pipe 28.

After fabrication of the descender 10 is completed, the outer surfaces are polished to provide smooth running surfaces for the line 11. Then preloading of the preferred embodiment of the descender 10 with line 11 is easily accomplished. To facilitate preloading, the clevis pin clip 50 is pulled from clevis pin hole 52 and then clevis pin 44 and spacer sleeve 46 are temporarily removed before the line 11 is loaded onto the descender 10. Then in the preferred method of preloading, the upper end 11*a* of line 11 is fed upwards through top area 29 from the side of the bottom pipe 22 from which trailing loop 36 protrudes; then upper end 11*a* is connected to appropriate anchor means. Then the lower segment of line 11 is reeved in a figure 8 pattern across the intersection of inner leg 16 and bottom pipe 22, then under and around the bottom pipe 22 then up, between and around the top pipe 28, and then down, between and around bottom pipe 22 and repeating until three wraps 11*b* are around top pipe 28. Then the lower segment of line 11 is brought between the top pipe 28 and the bottom pipe 22 thereby completing three figure 8 reeves between the top pipe 28 and the bottom pipe 22, then the lower segment is looped through a tailing loop 36. Then the clevis pin 44 and spacer sleeve 46, and clevis pin clip 50 are reincorporated into the preferred embodiment of the descender 10, thereby reclosing the gate.

When the preferred embodiment of the descender 10 is fully assembled and preloaded with line 11, the plurality of figure 8 reeves of the preloaded line 11 are safely retained within the confines of a lateral area 47 defined by inner leg 16, top pipe 28, spacer sleeve 46, and bottom pipe 22.

The descender 10 is designed for preferred use with a 3 mm Technora® line 11 that is reeved as described above in a series of figure 8s onto the descender 10 as shown in FIG. 1. The descender 10 is prepackaged and preloaded with a line 11 that may range upwards in length from 50 feet. The lower remainder of the line 11 not reeved on the descender 10 and not shown in the drawings preferably is organized in a small bag. When prepackaged for use, the upper end 11*a* of line 11 is connected to appropriate anchor means (not shown). In use, the anchor means anchor the line 11 to a secure anchor point i.e. parachute risers or tree limbs or other structurally strong anchor point before descent is begun. Appropriate anchor means include webbing or cordage with or without quick-snap connectors. Also before descent is begun, the U-shaped member 12 is attached by appropriate attachment means to the body of the user. Then the user may safely place his weight on the descender 10 and the line 11 and commence the descent.

When the descender 10 is not in use, it is stored in the top portion of the bag together with the anchor means discussed above. The small bag may be readily carried in a pocket of the parachutist's jumpsuit or otherwise as desired.

Before descent, the user anchors the anchor means to a secure anchor point and attaches the attachment means to the descender 10 and to user's body. In preferred use as preloaded, the best embodiment of the descender 10 allows speed control of the descent by the user applying with a finger or fingers a variable lateral compressing force to the figure 8 reeves within the lateral area 47. The lateral compressing force is applied in a direction parallel to and between the longitudinal axes of the top pipe 28 and the bottom pipe 22 and towards the inner leg 16. Alternatively, the user may control the speed of the descent by applying a variable pulling force on the line 11 below the tailing loop 38. The variable pulling force will impart a lateral compressing force to the figure 8 reeves within the lateral area 47. As descent is accomplished, the lower remainder of the line 11 is drawn from the bag and up through the tailing loop 36 and then through the figure 8 reeves and through the top area 29. The lateral compressing force causes the crossing lines in a plurality of figure 8 wraps to compress against each other increasing the friction between sequential crossing portions of line 11. When in place between the top pipe 28 and bottom pipe 22, the spacer sleeve 46 resists the force of compression imparted to the descender 10 by the line 11 when the line is subjected to load during descent.

The descender can also be used with larger cordage. If line 11 comprises 4 mm to 7 mm cordage, then two wraps around top pipe 28 instead of three wraps should provide the user of the descender 10 with adequate frictional surfaces to safely accomplish descent.

The present invention is novel and has utility as a key component in a rescue system. The method of using the descender 10 with figure 8 line reeving provides for the safe descent of an imperiled person from a high place such as a tree canopy environment to a lower elevation or the ground.

The simplicity and durability of the present invention allows for it to be safely stored for many months or years without degradation in its operability and strength. Use of the present invention in a rescue system promotes increased availability of the system because the invention permits implementation of a rescue system that does not require frequent inspection before the system is certified as qualified for use.

I claim:

1. A descender comprising:

a U-shaped member, said member having an outer leg and an inner leg, said legs pass up through a bottom pipe, said bottom pipe is securely joined to said outer leg, said U-shaped member with said bottom pipe defining an enclosed lower area, said legs after passing through said bottom pipe extend and pass into a top pipe, said top pipe is parallel to said bottom pipe, said top pipe is securely joined to said legs, said top pipe with said legs and said bottom pipe defining an enclosed top area, each pipe having an extending end that extends beyond said inner leg and in the direction away from said outer leg, and a removable bridging means between said extending ends.

2. A descender according to claim 1 further comprising a tailing loop securely joined to said bottom pipe and spaced between said outer leg and said inner leg.

3. A descender according to claim 1 wherein said removable bridging means include a clevis pin, said clevis pin having a clevis pin hole, said clevis pin inserted through said top pipe through a clevis pin through hole, then inserted through a spacer sleeve, then inserted through a wall hole in said bottom pipe, and then a clevis pin retaining clip is inserted into said clevis pin hole wherein said inner leg, said bottom pipe, said spacer sleeve, and said top pipe define an enclosed lateral area.

4. A descender according to claim 3 further comprising a tailing loop securely joined to said bottom pipe and spaced between said outer leg and said inner leg.

5. A descender comprising:

a U-shaped member, said member having an outer leg and an inner leg, said legs pass up through a bottom pipe, said bottom pipe is securely joined to said outer leg, said U-shaped member with said bottom pipe defining an enclosed lower area, said legs after passing through said bottom pipe extend and pass into a top pipe, said top pipe is parallel to said bottom pipe, said top pipe is securely joined to said legs, said top pipe with said legs and said bottom pipe defining an enclosed top area, and each pipe having an extending end that extends beyond said inner leg and in the direction away from said outer leg, and a nonremovable bridging means between said extending ends.

6. A descender according to claim 5 further comprising a tailing loop securely joined to said bottom pipe and spaced between said outer leg and said inner leg.

7. A descender according to claim 5 wherein said nonremovable bridging means include a bridging member securely joined between and to said extending ends.

8. A descender according to claim 7 further comprising a tailing loop securely joined to said bottom pipe and spaced between said outer leg and said inner leg.

* * * * *